US005233278A

United States Patent [19]

Carter

[11] Patent Number: 5,233,278

[45] Date of Patent: Aug. 3, 1993

[54] UNIVERSAL MOTOR SPEED SIGNAL CONVERTER

[76] Inventor: Edward F. Carter, Rte. 3, Box 234, Mt. Olive, N.C. 28365

[21] Appl. No.: 878,988

[22] Filed: May 6, 1992

[51] Int. Cl.[5] ..... D05B 69/18

[52] U.S. Cl. ..... 318/551; 112/217.4; 112/275

[58] Field of Search ..... 318/551; 112/217.3, 112/217.4, 274, 275, 277

[56] References Cited

U.S. PATENT DOCUMENTS 3,969,661 7/1976 Morinaga et al. .

4,310,788 1/1982 Hanyu et al. ..... 318/551

4,332,208 6/1982 Watasue et al. ..... 112/277

4,386,301 5/1983 Neki et al. .

4,976,552 12/1990 Ishikawa et al. ..... 388/811

*Primary Examiner*—Bentsu Ro

*Attorney, Agent, or Firm*—Olive & Olive

[57] ABSTRACT

Circuitry is provided capable of converting input motor speed control signals from one of two sewing machine motor speed switches into output signals adapted to control the speed of a particular type motor used to drive a sewing machine. Values are preset by the user to identify the motor and coordinate the signal conversion accordingly.

14 Claims, 6 Drawing Sheets

UNIVERSAL MOTOR SPEED SIGNAL CONVERTER

FIELD OF THE INVENTION

The invention relates to the field of motor speed controllers and more particularly to speed controllers for industrial sewing machine motors.

BACKGROUND OF THE INVENTION

An industrial sewing machine is typically controlled by means of a pivotal foot pedal operated switch depressed by the machine operator. Pressure applied in the toe direction actuates the motor and controls its speed—the greater the pressure, the faster the motor and sewing machine will run. Pressure applied in the heel direction actuates auxiliary functions, such as lifting of the presser foot and trimming the sewing thread end.

Each sewing machine, dependent on its manufacturer, utilizes a motor which requires a particular control device in terms of the operating signals generated for each function. Each motor typically comes equipped with its own unique microprocessor control. A control device suited to the motor's microprocessor is normally purchased with a sewing machine and its motor and becomes a permanent component of the associated sewing system. There are a number of sewing machine motors in use, including models made or sold under the names of Efka, Mitsubishi, Panasonic, Singer, Juki, Brother, Clinton and others.

Traditionally, sewing machine operators spend the entire work shift seated in front of their machines without a substantial change in position. This type of working habit has recently become recognized as the cause of several physical problems for long term sewing machine operators, among them back strain, circulatory problems and carpal tunnel syndrome. In recent industrial studies, significant change in the working position of the operator has been shown to help alleviate the effects of these physical problems as well as help increase operator efficiency. The ergonomic answer to the constant sitting situation is to raise the sewing machine table higher at times and allow the operator to stand while working. This stand and sit working position ability is done at the option of the operator and also serves to reduce fatigue.

There has been found to be a drawback to this solution of raising the table in that the speed controller foot pedal which is adapted and positioned for use by an operator in a seated posture is not well suited to use when the operator is standing. If the operator attempts to use the same controller standing as sitting, even if the foot controller is placed in an accessible position, the operator is forced to not put weight on the controller foot, thereby effectively standing on one foot. A one-foot standing postion cannot be maintained for long periods of time.

A solution to the problem of using a speed controller while sitting or standing is to use two separate speed controllers, one adapted for standing and one adapted for sitting. Physically, this is workable, but it has required the operator or the mechanic to electrically connect and disconnect the controllers at appropriate times, since the machine will not function properly with two simultaneous input speed control cords attached. The process of connecting and disconnecting the controllers tends to increase the time of changing from the sitting to the standing posture, and thereby makes the change less helpful and less efficient.

Therefore, a main objective of the present invention is to provide a sewing machine motor speed control device which allows operation of a sewing machine with the operator being in either a sitting or a standing posture.

An additional objective of the invention is to provide a motor speed control apparatus which is capable of interconnecting two foot pedal controllers to one motor.

A further objective of the invention is to provide a motor speed control apparatus which is useful with different brands of sewing machine motors.

Another objective of the invention is to provide a motor speed control apparatus which can be left connected electrically and physically without requiring resetting.

These and other objectives will become apparent to those skilled in the art as the disclosure is read and understood.

SUMMARY OF THE INVENTION

The invention disclosed provides an electrical circuit and a logic program adapted to convert input signals from one manufacturer's motor speed control device to signals usable in a different manufacturer's motor. The input signals are compared to data stored relating to the motor and speed control device being used and are converted to appropriate output signals. In this way, theoretically, any type speed control device can be used with any other type motor.

DESCRIPTION OF THE PREFERRED EMBODIMENT

Figure 5:
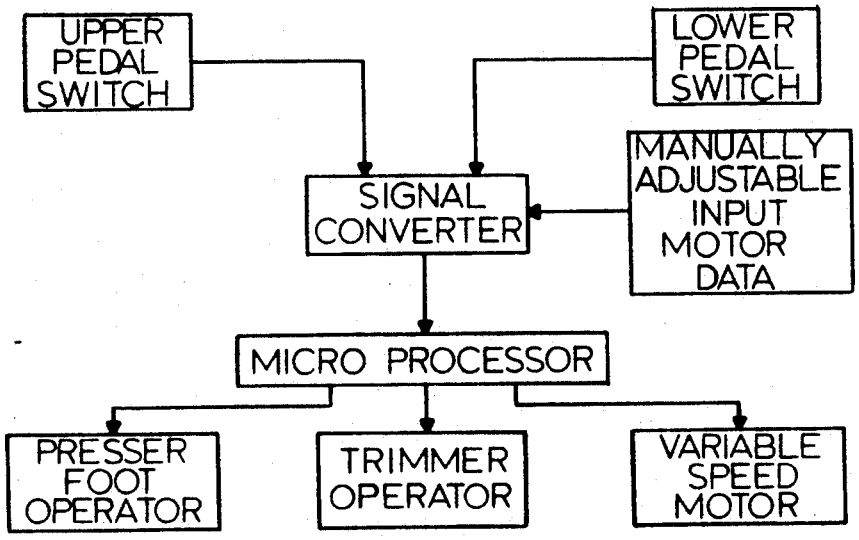
FIG. 5 is a diagrammatic representation of the input and output transmission of the signal converter of the invention.

Based on the needs as outlined above to enable a contemporary sewing machine to be controlled by one of a number of pedal switches, attention is called to FIG. 5 as a diagrammatic representation of the signal converter of the invention. The central apparatus depicted is the signal converter which is capable of receiving various input data and signals and sending output control signals. As will be described more fully below, a preliminary setting of input motor data is established by the user relating to the particular motor employed. There is an upper pedal switch and a lower pedal switch, which switches can be distinguished by the signal converter so that only one may be operative. The signal converter utilizes the input motor data and the pedal switch signal to generate an appropriate output signal which feeds into a microprocessor typically housed in the motor and controls either the motor speed, the trimmer or the presser foot of the sewing machine dependent on which pedal switch is operated and the extent and direction of operation.

Figure 1:
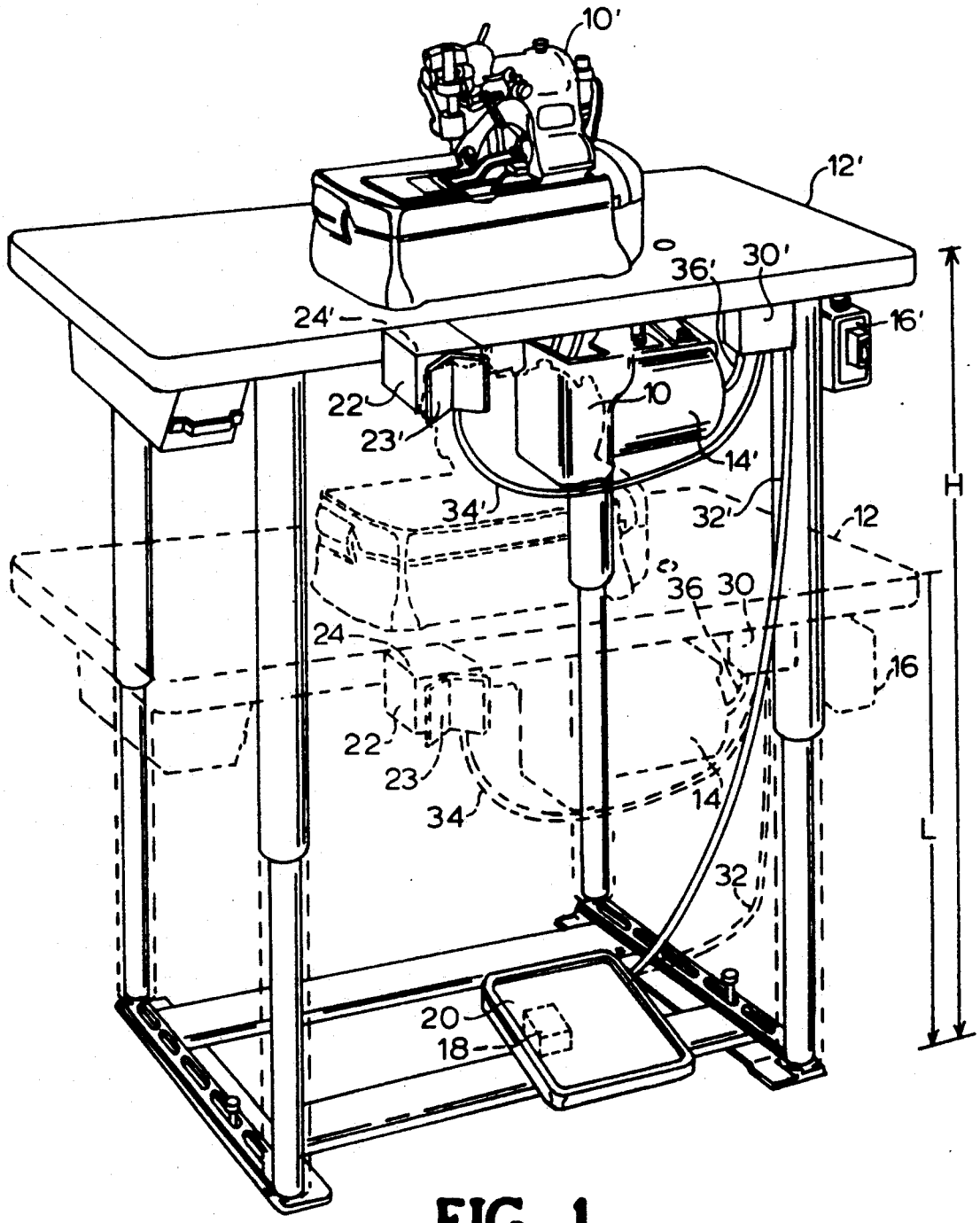
FIG. 1 is a perspective view of an industrial sewing machine on a work table adapted to be raised and lowered and showing the machine and table in an upper position in solid lines and in a lower position in dashed lines.

Relating now to the specific details of the invention, FIG. 1 illustrates a known mechanism for changing the working height of an industrial sewing machine table with a control device so as to allow a change in position for the operator from the usual sitting to one of standing. In both positions, the operator maintains a comfortable and efficient relationship to the height of the work surface. FIG. 1 further illustrates a typical industrial sewing machine 10 mounted onto a work table 12 in dashed lines at its traditional height L which is suited to an operator being seated. To permit this operator to work in a standing position, and thus overcome some of the traditional problems of repetitive work in a fixed work posture, the operator can raise the work table 12 and the sewing machine 10 to a greater height H, shown in solid lines. To differentiate the two operative positions of the equipment, apparatus components which can be so elevated are designated in the higher location, corresponding to height H, with a number primed; e.g. 10', 12'. etc. Therefore, the description of the parts at lower height L will apply similarly to the parts at the higher height designated by H.

Sewing machine drive motor 14' is mounted below table 12' in connective relationship so as to drive sewing machine 10' as is known. The motor 14' is typically an AC motor of a type which is capable of being speed controlled according to the voltage applied through a microprocessor, and to thereby vary the speed of operation of sewing machine 10'. The traditional means for varying the input voltage, and thus the machine speed, is by use of the treadle 20 which is pressed and pivoted by the foot of the operator. However, as discussed above, the treadle is awkward for use by an operator in a standing position. To allow the standing operator to controllably operate the sewing machine 10' at height H, a secondary motor controller 22' is positioned at the edge of table 12' closest the operator so that it may be actuated by pressure of the body of the operator. Controller 22' has an angular pressure plate 23' which corresponds to treadle 20 functionally. Similar to the foot treadle 20 function, when pressure plate 23' is pressed on left or right sides, motor speed, presser foot and trimmer functions are selectively activated dependent on the extent and direction in which plate 23' is pressed as later explained.

Figure 4B:
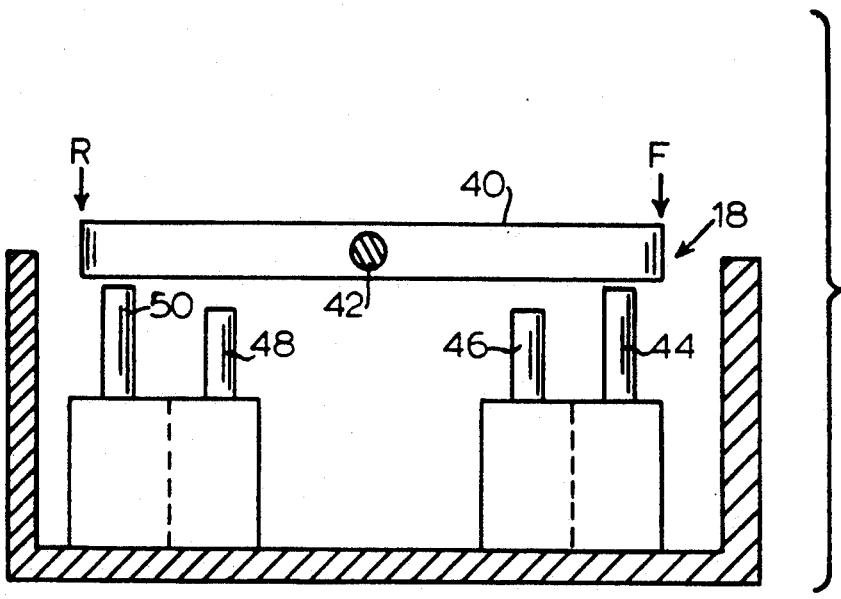
FIG. 4B is a side elevation cut away view of a typical lower pivoted pedal switch used to control a sewing machine.
Figure 4A:
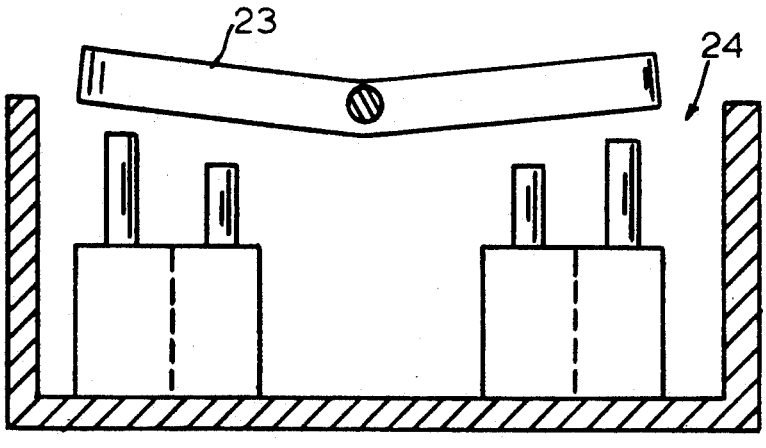
FIG. 4A is a side elevation cut away view of a typical upper pivoted pedal switch used to control a sewing machine.

The internal operative switch parts behind treadle 20 and secondary controller 22' are similar. In both units 20, 22', identical upper and lower pedal switches 18 and 24' are utilized. The term "pedal switch" is employed for both units although only one is foot actuated. FIGS. 4A, 4B diagrammatically illustrate the working arrangement of typical pedal switches 18, 24 which, in FIG. 1 are hidden behind either treadle 20 or behind secondary controller 22'. Such a mechanism useful as the pedal switch 18 or 24' is a Type EB101/EB102/EB103 switch supplied by Efka of America, Inc., Atlanta, Ga. Whereas pedal switches 18 and 24 are components supplied by Efka of America, Inc., and therefore in the prior art, the details of operation are merely depicted schematically. The significant features illustrated relate to the difference between the shapes of angular pressure plate 23 of FIG. 4A and planar pressure plate 40 of FIG. 4B.

Referring further to FIG. 4B, pivoted lever 40 of pedal switch 18 is positioned such that it can be pivoted by treadle 20. The description below relates to both pedal switches 18 (FIG. 4B) and 24 (FIG. 4A) which function similarly. Lever 40 is pivotally mounted on shaft 42 so as to move according to the direction of pressure applied, either in a forward direction (arrow F) or in a rearward direction (arrow R). When forward direction pressure F is applied, an electrical signal is generated to control the speed of a compatible motor in relation to the position of lever 40. When rearward direction pressure R is applied, an electrical signal is generated to actuate either the pressure foot or the trimmer device (not shown) of the sewing machine, depending on the extent of motion of lever 40. Each of the switches 10 44, 46, 48, 50 which are mounted within pedal switch 18 has two operative positions. Variation of the extent and direction of actuation of the four individual switches by the operator through the two discrete positions of each switch provides the capability of generating signals which in turn are capable of controlling the speed of motor 14 and certain auxilliary functions, such as lifting a presser foot and operating a trimmer. Although not illustrated, the presser foot and trimmer each are actuated by an electrically actuated operator. While the individual switches are not labelled in FIG. 4A, it is to be understood that pedal switch 24 is constructed and operates in the manner previously explained.

According to the preferred embodiment, the respective pedal switch 18 or 24' is employed as the universal input device regardless of which manufacturer's drive motor 14, 14' is used to drive the sewing machine 10, 10'. In order to send correct signals to the particular drive motor 14, 14' being used, a signal converter 30, 30' is built into the electrical control circuit and is connected between pedal switch 18 or 24' and motor 14, 14' as seen in FIG. 1. Signal converter 30 or 30' is designed to accept input from one of the two connected pedal switches 18 or 24' and to automatically lock out the respective second pedal switch 18 or 24' to avoid the possibility of conflicting signals, e.g. if both pedal switches 18 and 24' were pressed simultaneously.

Figure 2A:
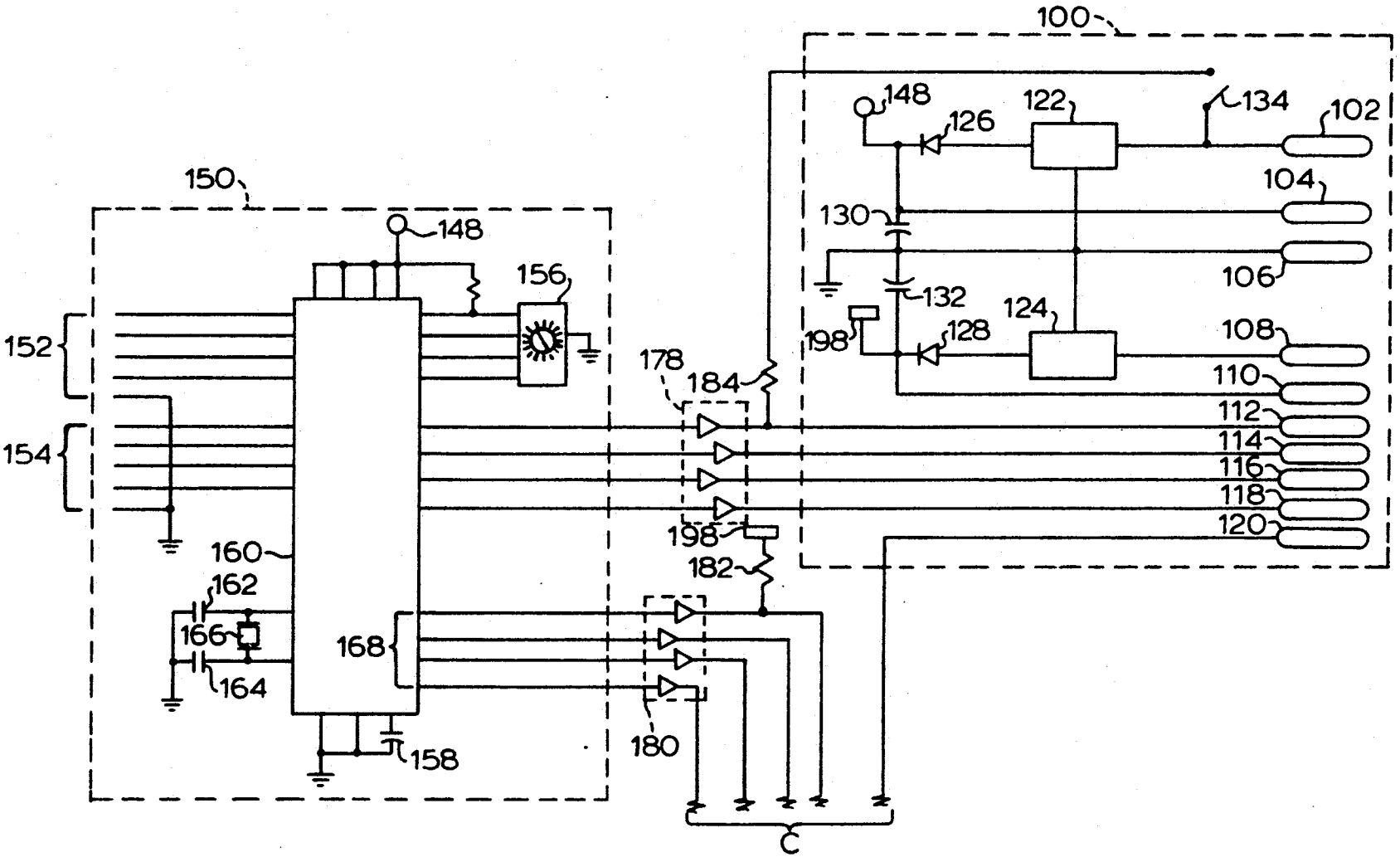
FIG. 2A is a partial diagram of the electrical circuit of the signal converter device of the invention and which connects directly to the circuit shown in FIG. 2B.
Figure 2B:
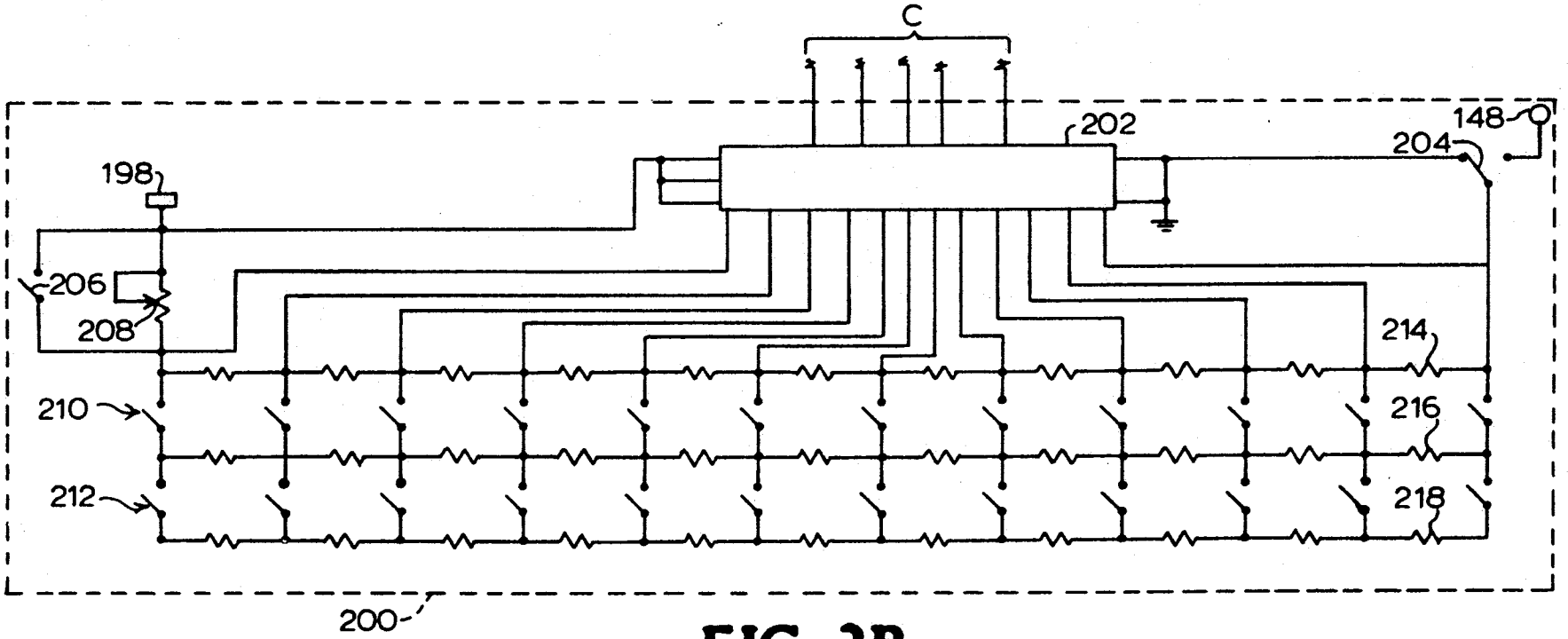
FIG. 2B is a partial diagram of the electrical circuit of the signal converter device of the invention and which connects directly to the circuit shown in FIG. 2A.

An electrical circuit diagram of the signal converter 30, 30' is illustrated in FIGS. 2A, 2B which diagrams are continuations of each other. The connections indicated at C on each diagram bridge the major sections of the circuits shown in the diagrams. The signal converter circuit of the invention can be considered as being generally divided into three main portions, an input-output portion 100, a digital control portion 150, and a digital-analog converter portion 200, each of which portions is indicated by a dashed box. Connections between the various portions is made through hex inverters 178, 180.

Additional connections between portions 100, 150, 200 exist through a first common contact symbolized as circle 148 shown for clarity in three locations and through a second common contact symbolized as box 198 shown for clarity in three locations. It is to be understood that in the completed circuit the contacts represented by circles 148 are connected together and the contacts represented by the boxes 198 are connected together. Contact 148 is established at a constant 5 volts DC.

Connecting pins 102–120, along with cables 152, 154 provide signal and power supply paths to and from the converter 30 or 30'. Pin 102 is connected to an external voltage source according to the motor used, pin 104 to a constant 5 volts DC and pin 108 to a constant 18 volts DC. Pin 106 is a ground connection, pin 110 is a control voltage source up to 15 volts DC, according to the requirements of the motor used and pins 112–120 communicate output signals from signal converter 30, 30' by way of the microprocessor motor speed controller to the motor being driven or to the presser foot and trimmer controls as previously referred to and as further schematically illustrated in FIG. 5.

Lower pedal switch 18 is connected, for example, through the wires in cable 152 (FIG. 2A) to the logic integrated circuit 160. Similarly, pedal switch 24' is connected through the wires in cable 154 to the logic integrated circuit 160. The output of logic integrated circuit 160, of a known construction as identified below, operates the auxiliary trimmer and the presser foot through pins 112–118 and through integrated circuit 202 (FIG. 2B), also of a known construction (FIG. 2A), pin 120 delivers the converted proper drive voltage to motor 14 or 14'.

Initial set up of the circuit of signal convertor 30, 30' to generate output appropriate to the specific motor being used, is by means of manually adjustable, rotary hexadecimal switch 156. In addition, switch 204 is moved to either a ground connection or to a 5 volts DC connection, the connection in FIG. 2B being illustrated as the ground connection.

Further matching is accomplished by setting of switches 210, 212, each of which closes 12 poles simultaneously. Switches 210, 212 (FIG. 2B) function to establish a balancing resistance in the control circuit to that of the motor used and switch 156 determines the necessary input-output relationship. The resistances connected to switches 210, 212 are such that, in the illustrated example, when both switches are open, the resistance is 30 K ohms, when switch 210 is closed, 10 K ohms, and when both switches 210, 212 are closed 1 K ohms. This variability has been found to be sufficient for the motors generally used for industrial sewing machines.

Specific components of the circuit shown in FIGS. 2A and 2B are listed below and divided into each major portion of the circuit. Specifications indicated for the circuit components are well known to those skilled in the art and are available from a variety of sources.

| Item | Generic name | Specification |
|---|---|---|
| | Input-Output Portion: | |
| 122 | Integrated circuit | LM 340 T-5 TO-220 |
| 124 | Integrated circuit | LM 340 T-15 TO-220 |
| 126 | Diode | IN 4001 |
| 128 | Diode | IN 4001 |
| 130 | Polar Capacitor | 220 ufd 25v |
| 132 | Polar capacitor | 220 ufd 25v |
| 134 | Switch × (pole A) | 2 pole DIP switch |
| | Digital Control and Related Portions: | |
| 156 | Dip switch hex | SW 217 ND |
| 158 | Polar capacitor | 1 ufd 16v |
| 160 | Integrated circuit | 8748 40 pin DIP |
| 162 | Capacitor | 27 pfd C4017 |

-continued

| Item | Generic name | Specification |
|---|---|---|
| 164 | Capacitor | 27 pfd C4017 |
| 166 | Crystal oscillator | XTL |
| 178 | Hex inverter | 7406 |
| 180 | Hex inverter | 7406 |
| 182 | Resistor | 4 × 100K ohms |
| 184 | Resistor | 4 × 100K ohms |
| | Digital-Analog Converter Portion: | |
| 202 | Integrated circuit | CD 4067 BE 24 pin DIP |
| 204 | Switch | SW 101 ND |
| 206 | Switch × (pole B) | 2 pole DIP switch |
| 208 | Variable resistor | 20 k ohms MAG 24 |
| 210 | 12 Position switch | A 624 ND |
| 212 | 12 Position switch | A 624 ND |
| 214 | 3 × 4 resistors | 2.7 k ohms |
| 216 | 3 × 4 resistors | 1.5 k ohms |
| 218 | 3 × 4 resistors | 100 ohms |

At several locations in the described circuitry, there are connections indicated to ground, as will be commonly understood.

The operation of the signal converter 30, 30' is next described in connection with the flow chart diagrammed in FIG. 3 in which the typical rectangular boxes designate operations and the typical diamond shaped boxes designate queries.

At the beginning of operation, the signal processing program starts at step 240. It next goes through an initialization routine including setting interrupt time intervals for event separation in step 242.

Step 244 indicates input motor data which is set by the user by appropriate setting of switch 156 (FIG. 2A). Step 248 operates to set the internal timer for the debounce, or verification routine.

Step 252 (FIG. 3) indicates input data from the pedal switch 18 or 24' as determined by the degree and direction in which the operator pivots treadle 20 or pressure plate 23, 23'. The input pedal signal is debounced, or rechecked, to avoid erroneous signals. In step 254, the system determines if either pedal switch 18 or 24' is set (selected) at a particular time. Here, the word "pedal" is descriptively used to refer to treadle 20 or pressure plate 23, 23'. If one pedal is not set, output No is selected and the program moves right to determine in step 256 which pedal switch 18 or 24' is in use. If lower pedal switch 18 is in use, the program moves to step 258 and selects internal connections corresponding to lower pedal switch 18. If the upper pedal switch 24' is in use, the program moves down and selects internal connections in step 260 corresponding to upper pedal switch 24'. From each of the above steps 258, 260, an output goes to query 262 to verify that the signal is from the selected pedal switch, thus locking out the non-selected pedal switch signal. If the answer to query 254 is yes, a particular pedal switch is set, and the signal generated in step 252 passes to step 262. If the response in step 262 is No, the program returns to A and recycles to acquire new information. If the response is Yes, the program drops to step 264 and sends the pedal switch signal to a preset table which the converter 30 has in memory establishing motor or pedal switch values. Having obtained pedal value information in step 264, the program utilizes pedal value and the motor data (previously set by the user) in step 266 to obtain a motor value from a memory table. In step 266, the converter sends a signal to the digital-analog converter portion 200 of FIG. 2B, which signal is transmitted to the motor through pin connectors 112–120 of FIG. 2A, thereby controlling the trimmer, presser foot and motor speed through the motor microprocessor. The program next automatically recycles to A to obtain fresh information.

It is to be understood that the input pedal signal established in step 252 and converted to an upper or lower pedal switch lock in steps 258, 260 is retained permanently in memory. To switch to the alternate pedal, it is necessary to deenergize the signal converter, which is normally done when changing from high to low table position.

Each of the motors which may be employed typically sold under names such as Juki, Panasonic, Singer, Clinton, etc., has a particular logic configuration as to how the input data for motor speed, presser foot and trimmer is accessed. The programmed configuration in integrated circuits 160, 202 incorporates converting code to specifically feed each motor 14, 14' from a common pedal switch 18 or 24' in appropriate relationships. That is, if the four connections of pedal switch input 152 are designated Q, R, S, T, for example, and Q is for the presser foot lift operation, a Juki microprocessor may, for example, comprehend an S as the presser foot signal. The integrated circuits 160, 202 determine, for example, according to the operations described above that the signal is from an Efka pedal switch 24' and the motor 14 is a Juki, so it sends out an "S" in response to a Q input. Similar conversions are accommodated to the various motors anticipated to be potentially employed. The resistor banks 214, 216, 218 set by switches 210, 212 (FIG. 2B) serve to establish the range of output voltage for speed control according to the particular motor being used thereby establishing an analog output signal corresponding to the digital input.

Figure 3:
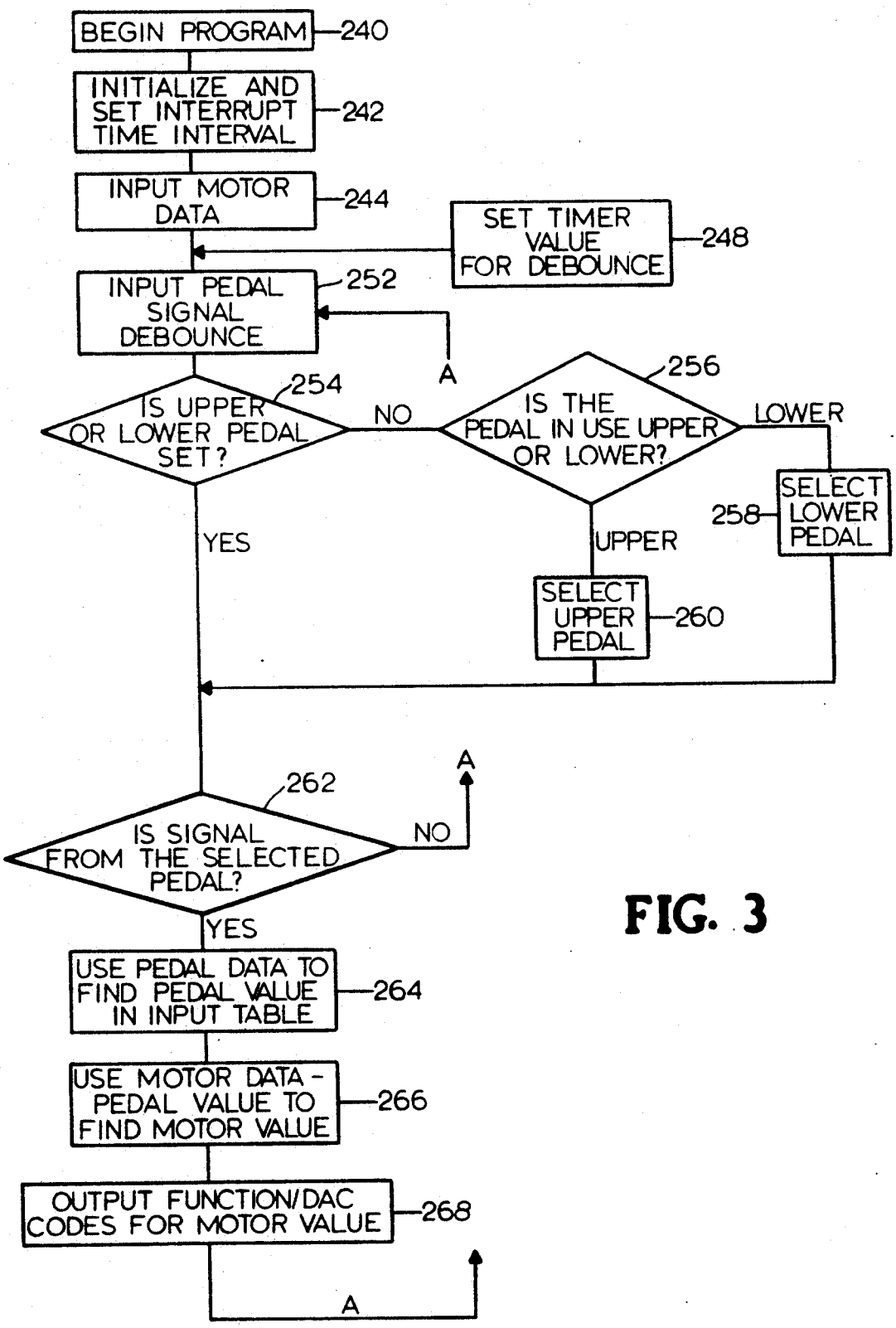
FIG. 3 is a flow chart of the processing program built into integrated circuits included in the electrical diagrams of FIGS. 2A, 2B.

Operating as described above, the electrical diagram operation according to the flow chart function of FIG. 3 is capable of locking out the second pedal switch 18 or 24' and converting the particular signal from a common input style switch to a particular output style according to the motor employed. The machine operator is thus able to use multiple machine switches with a single motor, and is able to raise or lower the sewing machine table at the option of the operator. From what has been described, it will be seen that the circuitry of the invention is adaptable to a variety of variable speed motor applications in which the motor is controlled by one or more remote signal generator switches. Therefore, the scope and principles of the present invention are not to be construed as limited by the preferred embodiment, but are defined by the claims which follow.

What is claimed is:

1. A sewing machine apparatus, comprising:

(a) a sewing machine driven by a variable speed motor having an associated motor speed control actuated by unique form of motor speed signal;

(b) a manually actuated switch having a plurality of manually obtained positions and means for generating a motor speed signal at each position corresponding to a particular motor speed, each such generated motor speed signal however being of a form which is incompatible with the form of said unique motor speed signal required to control the speed of said variable speed motor; and (c) converter circuitry means being manually adjustable to preset motor data corresponding to the form of said unique motor speed signal, being connected between said motor speed control and said manually actuated switch and being operative in response to said preset motor data and said generated motor speed signal to generate a corresponding signal of a form compatible with said unique form of motor speed signal whereby to operate said motor at a selected speed corresponding to the position of said manually actuated switch.

2. A sewing machine apparatus as claimed in claim 1 wherein said converter circuitry means is manually adjustable to preset said converter circuitry means so as to generate a signal of a form compatible with any one of a selected plurality of variable speed motors, each actuated by a selected unique form of motor speed signal.

3. A sewing machine apparatus as claimed in claim 1 wherein said manually actuated switch is located on the sewing machine apparatus in a relatively low position suited for being foot operated.

4. A sewing machine apparatus as claimed in claim 1 wherein said manually actuated switch is located on the sewing machine apparatus in a relatively high position suited for being operated by an operator in a standing position.

5. A sewing machine apparatus, comprising:

(a) a sewing machine driven by a variable speed motor having an associated motor speed control actuated by a unique form of motor speed signal;

(b) a first manually actuated switch having a plurality of manually obtained positions and means for generating a motor speed signal at each position corresponding to a particular motor speed, each such generated motor speed signal however being of a form which is incompatible with the form of said unique motor speed signal required to control the speed of said variable speed motor;

(c) converter circuitry means connected between said motor speed control and said manually actuated switch and being operative in response to said generated motor speed signal to generate a corresponding signal of a form compatible with said unique form of motor speed signal whereby to operate said motor at a selected speed corresponding to the position of said manually actuated switch;

(d) said first manually actuated switch being located on the sewing machine apparatus in a relatively low position suited for being foot operated;

(e) a second manually actuated switch having a plurality of manually obtained positions and means for generating a second motor speed signal at each position corresponding to a second particular motor speed, each such generated second motor speed signal however being of a form which is incompatible with the form of said unique motor speed signal required to control the speed of said variable speed motor, said second manually actuated switch being located on the sewing machine apparatus in a relatively high position suited for being operated by an operator in a standing position;

(f) said converter circuitry means being further connected to said second manually actuated switch and being operative when either manually actuated switch is generating a motor speed signal to block the input from the other manually actuated switch.

6. A sewing machine apparatus as claimed in claim 5 wherein said sewing machine further includes a presser foot, a signal actuated presser foot operator, a trimmer and a signal actuated trimmer operator, said converter circuitry means being connected between said presser foot operator and said trimmer operator and said first and second manually actuated switches, which switches are adapted to generate respective presser foot operator and trimmer operator signals of one form and said converter circuitry means being operative in response to receiving such signals of one form to generate corresponding signals suited as actuating signal inputs to said presser foot operator and said trimmer operator.

7. A sewing machine apparatus as claimed in claim 5 further including means for enabling said sewing machine, said variable speed motor and said second manually actuated switch to be elevated to a position suited to an operator being in a standing position.

8. A sewing machine apparatus, comprising:

(a) a sewing machine driven by a variable speed motor having an associated motor speed control actuated by a unique form of motor speed signal;

(b) a plurality of machine pedal switches each having a plurality of manually obtained positions and means for generating a motor speed signal at each position corresponding to a particular motor speed, but of a form which is incompatible with the form of said unique form of motor speed signal required to control the speed of said variable speed motor;

(c) converter circuitry means connected between said motor speed control and said plurality of machine pedal switches, said converter circuitry means being adapted to process a first generated motor speed signal coming from one of said machine pedal switches and to lock out any subsequent signal coming later from another of said machine pedal switches, said converter circuitry means being manually adjustable to preset motor data in said converter circuitry means such that in response to said first generated motor speed signal, said converter circuitry means generates and transmits to said motor speed control a motor speed control signal of a form compatible with said unique form of motor speed signal whereby to operate said motor at a selected speed corresponding to the position of said one machine pedal switch.

9. A sewing machine apparatus as claimed in claim 8 wherein said converter circuitry means includes a plurality of manually adjustable switches operative to preset said motor data.

10. A sewing machine apparatus as claimed in claim 8 wherein said plurality of machine pedal switches comprise two machine pedal switches located at corresponding operator standing and sitting positions.

11. A sewing machine apparatus as claimed in claim 8 wherein each said machine pedal switch also includes other manually obtained positions and means for generating respective trimmer and presser foot control signals corresponding to such other positions, said converter circuitry means being operative in response to said respective trimmer and presser foot control signals to actuate trimmer and presser foot operators associated with said sewing machine.

12. A method for converting in a converter circuitry means an input signal from a sewing machine pedal switch to an output signal for controlling the speed of a variable speed drive motor for a sewing machine, comprising the steps of:

(a) inputting to the converter circuitry means user supplied data relating to the variable speed drive motor being used;

(b) receiving in the converter circuitry means a signal from one of a first or a second machine pedal switch;

(c) determining within the converter circuitry means if said first or second machine pedal switch is set;

(d) setting a controller within the converter circuitry means to accept signals only from the pedal switch which is set and to reject signals from the other pedal switch;

(e) comparing said user supplied data and said machine pedal switch signal to a memory table within the converter circuitry means to obtain a motor value; and (f) transmitting said motor value from said converter circuitry means to said motor by means of a digital to analog converter.

13. The method of claim 12 further including the step of converting another input signal from the sewing machine pedal switch which is set to an output signal for controlling an auxiliary function on the sewing machine.

14. The method of claim 12 further comprising the step of setting said first or second machine pedal switch and from which a signal is received if said pedal switch setting is not set.

* * * * *

UNITED STATES PATENT AND TRADEMARK OFFICE

CERTIFICATE OF CORRECTION

PATENT NO. : 5,233,278

DATED : August 3, 1993

INVENTOR(S) : Edward F. Carter

It is certified that error appears in the above-identified patent and that said Letters Patent is hereby corrected as shown below:

Column 4, line 25, delete "10".

Column 7, line 54, insert --a-- before "unique".

Signed and Sealed this

Fifteenth Day of March, 1994

*Attest:*

Bruce Lehman

BRUCE LEHMAN

*Attesting Officer*

*Commissioner of Patents and Trademarks*